United States Patent [19]

Adams et al.

[11] 4,283,602

[45] Aug. 11, 1981

[54] CRYPTOGRAPHICALLY SECURE COMMUNICATION SYSTEM

[75] Inventors: Robert T. Adams, Short Hills, N.J.; Paul E. Ahrens, Hicksville, N.Y.; John Granlund, Short Hills, N.J.

[73] Assignee: International Telephone and Telegraph Corporation, New York, N.Y.

[21] Appl. No.: 761,879

[22] Filed: Sep. 23, 1968

Related U.S. Application Data

[63] Continuation-in-part of Ser. No. 555,074, Jun. 3, 1966.

[51] Int. Cl.[3] ..... H04K 1/02

[52] U.S. Cl. ..... 179/1.5 R; 178/22.01

[58] Field of Search ..... 178/22; 179/1.5 E, 1.5 R

[56] References Cited

U.S. PATENT DOCUMENTS

| | | | |
|---|---|---|---|
| 3,038,028 | 6/1962 | Henze | 178/22 |
| 3,427,399 | 2/1969 | Ehrat | 179/1.5 R |
| 3,976,839 | 8/1976 | Miller | 179/1.5 R |
| 3,985,958 | 10/1976 | Dudley | 179/1.5 R |

*Primary Examiner*—Howard A. Birmiel

*Attorney, Agent, or Firm*—John T. O'Halloran; Alfred C. Hill

[57] ABSTRACT

This relates to a cryptographically secure communication system employed with an analog input, an analog output and a transmission medium each having a given low frequency pass band with a predetermined bandwidth. The input analog signal is sampled and then quantized to have an amplitude equal to one of a predetermined number of discrete amplitude levels. This quantized signal is applied together with a first sequence of signal representing randomly and with substantially equal probability the discrete amplitude levels to a modulo - M adder to encrypt the sample pulses. These encrypted sample pulses are converted to an encrypted analog signal for propagation through the transmission medium. The encrypted analog signal is received from the medium and then sampled and quantized to provide the encrypted amplitude samples at the receiver. These encrypted samples are applied together with a second sequence of signals identical to and synchronous with the first sequence of signals to a modulo - M subtractor to decrypt the received encrypted samples to recover the original analog signal samples which are then converted to an analog output signal. It is also possible to employ a modulo - M subtractor to encrypt the sample pulses and a modulo - M adder to decrypt the received encrypted samples.

10 Claims, 8 Drawing Figures

FROM TIMING SIGNAL SOURCE 44 OR 47
PAM TO DIGITAL CONVERTER
RANDOM, EQUAL PROBABILITY 2n-LEVEL DIGITAL SIGNAL GENERATOR
INHIBITOR
AND
OR
DELAY DEVICE
SAMPLER TIMING SIGNAL FROM SOURCE 44 OR 47
DIGITAL TO PAM CONVERTER
ADDER WITH n-1 BIT CARRY
SUBTRACTOR WITH n-1 BIT BORROW
A OR C
B OR D
C OR A
D OR B

CRYPTOGRAPHICALLY SECURE COMMUNICATION SYSTEM

CROSS-REFERENCE TO RELATED APPLICATION

This is a continuation-in-part of copending application Ser. No. 555,074, filed June 3, 1966.

BACKGROUND OF THE INVENTION

This invention relates to communication systems and more particularly to a cryptographically secure communication system employed with a transmission medium having a low frequency pass band and relatively narrow bandwidth, such as a telephone transmission channel and the like.

There is no easy way to encrypt speech or any other analog waveform so that no information about the waveform is available from the encrypted version, and yet the decryption process recovers the waveform exactly. On the other hand, if the waveform is transmitted approximately, being represented as a sequence of discrete symbols selected from a finite alphabet, there are ways of encrypting that deny all information about the waveform to an observer of the transmitted symbols. Such a prior art arrangement of encrypting speech waveforms by this approximation process is described hereinbelow with respect to FIGS. 1, 2 and 3. This prior art arrangement, however, has the disadvantage of effectively amplifying noise introduced in the transmission medium and thereby reducing its effectiveness.

SUMMARY OF THE INVENTION

An object of this invention is the provision of a cryptographically secure communication system wherein the encrypted speech waveform is transmitted in the same bandwidth as occupied by the original speech waveform.

Another object of this invention is the provision of a cryptographically secure communication system that does not amplify the changes induced in the encrypted waveform by noise present in the transmission medium.

A feature of this invention is to provide a cryptographically secure communication system employed with a transmission medium having a given low frequency pass band and a predetermined bandwidth comprising a source of analog signal confined to the given pass band and the predetermined bandwidth coupled to a first means which provides amplitude sample pulses from the analog signal at a given rate related to at least twice the predetermined bandwidth with each of these sample pulses having a discrete amplitude equal to one of a predetermined number of discrete amplitude levels. A second means provides a first sequence of signals representing randomly and with substantially equal probability the predetermined number of discrete amplitude levels with the first sequence of signals being coincident with the sample pulses. A third means is provided which is responsive to the sample pulses and the first sequence of signals to encrypt the sample pulses and a fourth means is coupled between the third means and the transmission medium to convert the encrypted sample pulses to an encrypted analog signal confined to the given pass band and the predetermined bandwidth for propagation through the transmission medium. A fifth means receives the propagated encrypted analog signal from the transmission medium and provides encrypted amplitude sample pulses from the encrypted analog signal at the given rate with each of the encrypted sample pulses having a discrete amplitude equal to one of the predetermined number of discrete amplitude levels. A sixth means which is synchronous with the second means provides a second sequence of signals identical to the first sequence of signals coincident with the encrypted sample pulses with a seventh means being responsive to the encrypted sample pulses and the second sequence of signals to decrypt the encrypted sample pulses and recover the sample pulses. These sample pulses are then converted to the analog signal confined to the given pass band the predetermined bandwidth for utilization.

Another feature of this invention is to add the first sequence of signals to the sample pulses modulo M, where M is an integer equal to the predetermined number of discrete amplitude levels in the transmitter while the second sequence of signals is subtracted modulo M from the encrypted sample pulses in the receiver.

Still another feature of this invention is the subtraction of the first sequence of signals modulo M from the sample pulses in the transmitter while in the receiver the second sequence of signals is added modulo M to the encrypted sample pulses.

A further feature of this invention is the provision of a cryptographically secure communication system wherein the random sequences of signals are combined with the sample pulses at points where the latter are represented in binary form, and the addition or subtraction is accomplished with (n-1) bits of carry or borrow, respectively, in the transmitter and the subtraction or addition in the receiver is accomplished with (n-1) bits of borrow or carry, respectively, where n is equal to the number of binary bits representing the discrete amplitude levels to which the sample pulses are quantized.

BRIEF DESCRIPTION OF THE DRAWING

The above mentioned and other features and objects of this invention will become more apparent by reference to the following description taken in conjunction with the accompanying drawings, in which:

FIG. 6 is substituted for the components between lines A—A and B—B of FIG. 4 and FIG. 7 is substituted for the components between lines C—C and D—D of FIG. 4 and the other system when FIG. 7 is substituted for the components between lines A—A and B—B of FIG. 4 and FIG. 6 is substituted for the components between lines C—C and D—D of FIG. 4; FIG. 6 is substitute for the components between lines A—A and B—B and FIG. 7 is substituted for the components between lines C—C and D—D.

DESCRIPTION OF THE PREFERRED EMBODIMENTS

As was pointed out hereinabove there are ways of encrypting speech or other analog waveforms that deny all information about the waveform to an observer when the waveform is transmitted approximately, that is when it is represented by a sequence of discrete symbols selected from a finite alphabet. Suppose that the analog waveform to be transmitted is confined to a low frequency pass band with a relatively narrow bandwidth w cps (cycles per second) wide. For instance, a telephone speech waveform is confined to the frequency band below 4 kilocycles (kc). Then according to the sampling theorem the waveform can be constructed exactly from 2w samples per second, uniformly spaced. Let the amplitude of the sample be made discrete by quantizing each sample into one of $2^n$ levels, where n equals the number of binary bits representing the discrete amplitude levels. Doing this an approximation of the waveform can be recovered if one of the $2^n$ symbols, representing the levels, is transmitted 2w times per second. This as yet is not a cryptographically secure binary system of communication but can be made cryptographically secure by converting the quantizer output to binary form and adding, modulo 2, "unpredictable" bits from a random sequence code generator.

Figure 1:
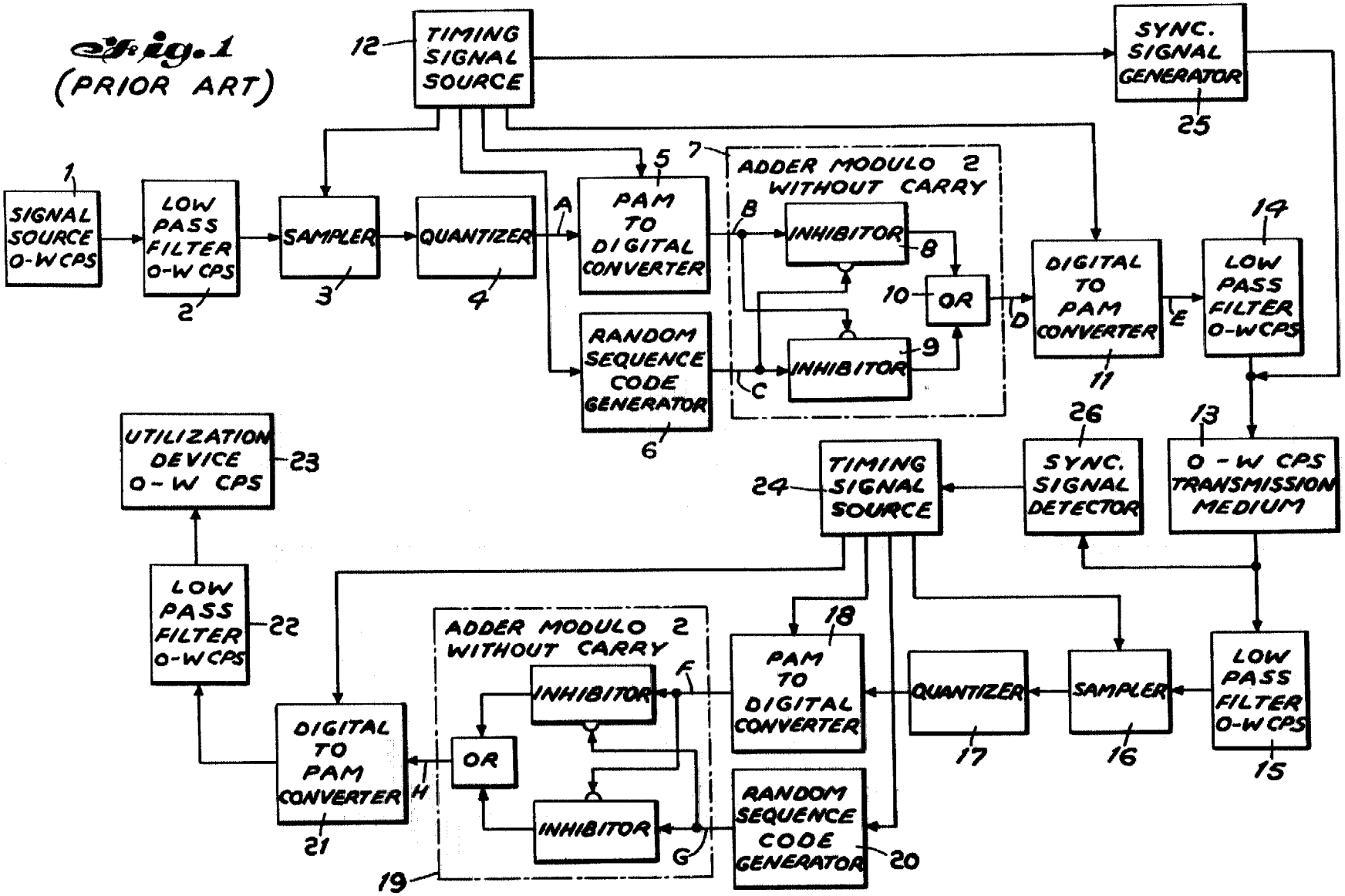
Fig. 1 (PRIOR ART)
FIG. 1 is a block diagram of a prior art cryptographically secure communication system having the disadvantage of effectively amplifying transmission medium noise as mentioned hereinabove.
Figure 2:
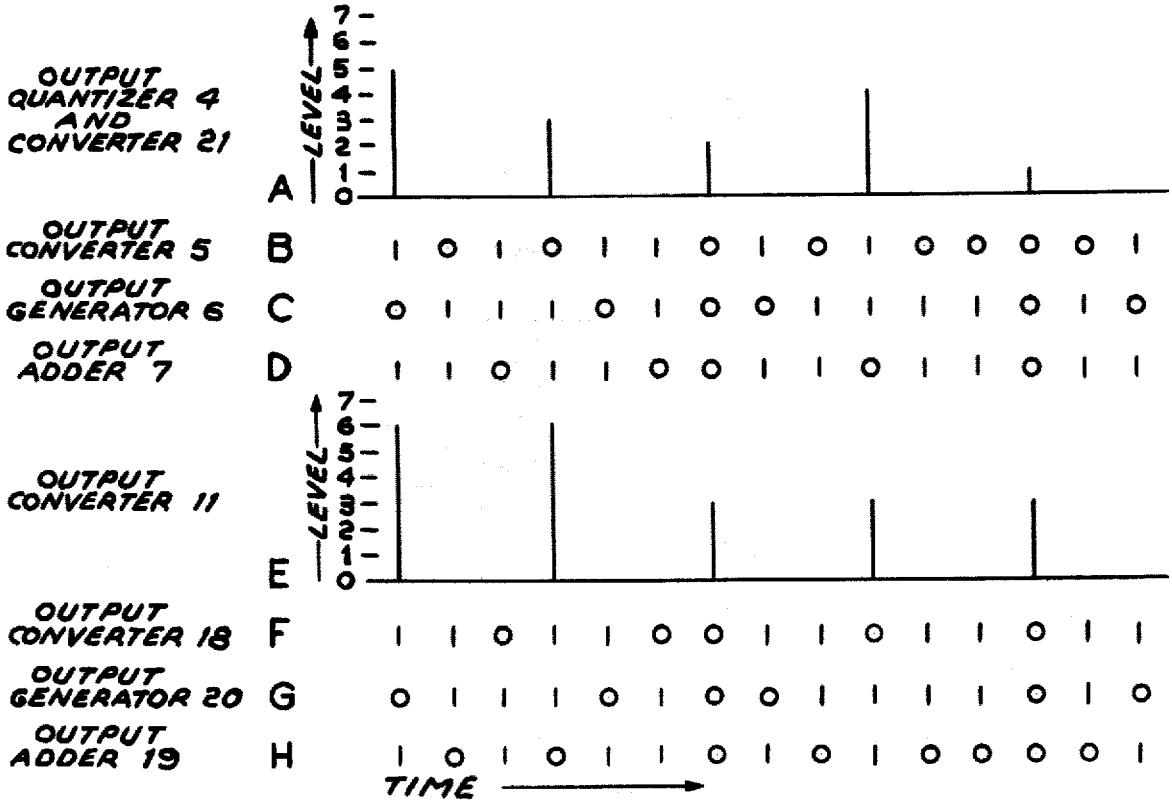
Fig. 2 (PRIOR ART)
FIGS. 2 and 3 are waveforms and a symbolic illustration useful in explaining the operation of FIG. 1 and the disadvantage thereof, respectively.

The foregoing is illustrated in the system of FIG. 1 wherein source 1 represents the source of signals confined to a o-w cps pass band. The output of source 1 is coupled to low pass filter 2 having this same pass band characteristic. The output of filter 2 is sampled by sampler 3 and quantized by quantizer 4 thereby causing the samples from sampler 3 to have a discrete amplitude at one of $2^n$ levels depending upon the amplitude of the signal from source 1. The output of quantizer 4, as illustrated in curve A, FIG. 2 is coupled to pulse amplitude modulation (PAM) to digital converter 5 to produce the binary signal representing the quantized sample pulse as illustrated in curve B, FIG. 2. The random sequence code generator 6 has some "unpredictable" stream of bits which should have a relatively long repetition. A representative sequence is illustrated in curve C, FIG. 2. The output of generator 6 and the output of converter 5 are added modulo 2 without carry in adder 7. Adder 7 may include as one form thereof inhibitors 8 and 9 and OR gate 10. With this type of added 7 a "1" output from converter 5 and a "1" output from generator 6 will inhibit inhibitors 8 and 9 and thus produce a "0" output from OR gate 10. If the output from one of converter 5 or generator 6 is "0" and the output from the other of converter 5 or generator 6 is "1," the inhibitor coupled to the other of converter 5 or generator 6 will not be inhibited and, hence, the "1" output will pass through OR gate 10 and will produce a "1" output at point D. If on the other hand both generator 6 and converter 5 have a "0" output inhibitors 8 and 9 will not be inhibited and the resultant output of OR gate 10, point D, is "0." This is simple binary addition without carry and is illustrated in curves B, C and D, FIG. 2, wherein curve D illustrates the result of the simple binary addition of curves B and C without carry in adder 7.

The output from adder 7 is coupled to digital to PAM converter 11 wherein the encrypted binary signal, Curve D FIG. 2, is converted to an encrypted analog sample pulse, as illustrated in curve E, FIG. 2.

It should be noted that the timing source 12 controls the timing of sampler 3, converter 5, generator 6, and converter 11. The timing of converter 5, generator 6 and converter 11 is determined by the number of binary bits employed to represent a discrete amplitude level of the quantized output of quantizer 4. Sampler 3 is timed to sample the analog signal at a rate of at least two times the highest expected frequency in the signal from source 1. In the illustration of FIG. 2 and the explanation of FIG. 1, it has been assumed, for purposes of explanation only, that the converter 5 and converter 11 are operating at the rate required by three binary bits to represent eight quantized levels. It is to be understood that in practice about six bits would be required to specify each level, in which case six encrypting bits for each level transmitted would be required from code generator 6 in coincidence with the bits of the output of converter 5. The fidelity of the approximate waveform is impaired by quantizing noise if many less than six bits are actually used, and the fidelity is improved by increasing the number of bits per sample.

If we assume a six bits per sample which produce 64 quantized levels, the bit rate is then 12w bits per second which is practically impossible to transmit in binary form through a transmission medium 13 having a bandwidth of only w cps. To permit the approximate encrypted version of the signal of source 1 to be transmitted through medium 13 the encrypted bits at the output of adder 7 are converted into quantized encrypted sample pulses in converter 11 and passed through low pass filter 14 which effectively integrates the output of converter 11 to produce a waveform referred to herein as an encrypted analog signal, which may now be easily transmitted through transmission medium 12.

The output of medium 13 is applied to low pass filter 15 to remove out of band noise introduced by the medium and, hence, to sampler 16 which acts to sample the encrypted analog waveform. These samples are quantized in quantizer 17 producing encrypted samples similar to curve E, FIG. 2 but not exactly due to interference in medium 13 prior to application to the PAM to digital converter 18 at whose output again appear the encrypted sample pulses in binary form, such as illustrated in curve F, FIG. 2. This output is applied to adder 19 with the other input to adder 19 being received from random sequence code generator 20 operating synchronously with generator 6 to produce the same random sequence of coded pulses as generator 6. The output of generator 20 is illustrated in curve G, FIG. 2. As in the arrangement in the transmitting of this system the output from converter 18 and the output from generator 20 are added modulo 2 without carry in adder 19 which includes the same components and operates in the same manner as adder 7. The output from adder 19 is illustrated in curve H, FIG. 2. It will be recognized that this is identical to the output of converter 5, as illustrated in curve B, FIG. 2, which represents in binary form the sample pulses of the signal of source 1. The digital to PAM converter 21 then converts the output from adder 19 to the sample pulses, substantially as illustrated in curve A, FIG. 2 but slightly different therefrom due to the above-mentioned interference in medium B. These sample pulses which are identical to the sample pulses at the output of quantizer 4 are applied to a low pass filter 22 for recovery of the signal of source 1 for application to utilization device 23.

It will be appreciated by one skilled in the art that the receiver and transmitter must be synchronized to achieve the desired results. This synchronization must be both frame synchronization to assure that code generator 20 starts at the same point in the code sequence that code generator 6 starts at and bit synchronization to assure that the transitions of the codes from generators 6 and 20 are in phase and that the timing signals to sampler 16 and converters 18 and 21 of the receiver are in phase with the timing signals to sampler 3 and converters 5 and 11 of the transmitter. There are many known ways of accomplishing this desired synchronization. One way of providing frame synchronization is to employ known "start signal," or "sync burst" techniques. According to these techniques, the start signal, or sync burst, is transmitted prior to the trasmission of communication signals to assure that generators 6 and 20 start at the same point, namely, from their zero or start position. One way of providing bit synchronization is by utilizing a pilot tone disposed near the upper limit of the bandwidth of the signal transmitted through medium 13 (such as 4 KC pilot tone) which will be employed in the receiver to control the phase of a local voltage controlled oscillator to achieve time coincidence in the transitions of the code stream and the various other timing signals.

One example of employing these two techniques for frame and bit synchronization may be described as follows. Sync signal generator 25 would include a pilot tone generator and a start signal generator. The start signal generator would produce a distinctive pattern of pulses so that when it is operated on by medium 13, which effectively filters the pulses, there is provided a distinctive transition from which timing of the receiver can be determined. For instance, the start signal may be a twenty symbol, or pulse, signal having ten positive, full amplitude (largest possible code level) pulses spaced by a given amount and ten negative, full amplitude pulses spaced by said given amount. The positive pulses and negative pulses of this start signal would each occupy the same given time duration. When this distinctive pulse pattern is operated on by medium 13 there is produced at the output thereof a positive analog signal having a duration substantially equal to the duration of the positive pulses and a negative analog signal having a duration substantially equal to the duration of the negative pulses with a transition between the negative and positive analog signals. The specifications of this start signal would be known beforehand so that the detector of this start pulse in the receiver can be properly designed to control the start of generator 20 and the clock of source 24. Timing signal source 12 would include a clock of predetermined frequency, such as 4 KC, and appropriate multipliers coupled thereto to provide the necessary timing signals for sampler 3, converters 5 and 11 and code generator 6. In addition, timing signal source 12 would include a start button and a reset button, which in the case of a telephone system, could be the hook of a hand telephone set where raising the hand set would be the start switch and the replacing of the hand set would be the reset switch with, of course, an appropriate voltage source applied thereto to activate the various circuits in source 12 and generator 25 and generator 6. With these exemplary components contained in source 12 and generator 25, the operation would be as follows. Initially, prior to making a call, there would be no pilot tone from generator 25, no timing pulses to generator 6 and no timing pulses to sampler 3 and coverters 5 and 11. When it is desired to initiate a call the start button would be depressed which will apply a control potential to the start pulse generator for activation thereof to produce its distinctive start code pattern such as described hereinabove and would reset code generator 6 to its start position. Synchronously with the last pulse or symbol of the start pulse the clock is activated by the control potential (through a suitable delay device having a delay equal to the time required to generate the start signal) to energize the clock of source 12 to provide the timing signals for the generator 6, sampler 3 and conveters 5 and 11 and at the same time turns on the pilot tone generator of generator 25. The reason for maintaining the clock and timing signals to the various components turned off is that it is desired to have the start signal effectively transmitted in the clear, that is, without intelligence from converter 11 which could distort and render the start signal inaccurate. When the timing signals are applied to the various components from source 12, communication can commence and at the end of the communication, the reset button is activated and returns the transmitter to its initial condition.

At the receiver the initital conditions are that the clock in source 24 is off, generator 20 is reset to its condition which is identical to the start condition of generator 6. With the clock in source 24 being off, no timing signals are applied to generator 20, sampler 16 and converters 18 and 21. Sync signal detector 26 includes a start signal detector and a pilot tone detector. The start signal detector is initially in its operative condition. The start signal detector of detector 26 is a device that determines when a start pulse has been received by checking the received analog waveform against suitable threshold and duration criteria for both the positive analog and negative analog portion of the start signal at the output of medium 13. If the positive analog portion exceeds the threshold criteria for a duration substantially equal to the duration of the period the the full amplitude positive pulses are generated by the start signal generator of generator 25, the start pulse detector then knows that it has reached the transition between the positive and negative analog portions of the start signal. Detection of this transition produces a pulse which is then applied to a delay device which has a delay equal to the duration that the negative, full amplitude pulses are generated by the start pulse generator of generator 25. If the negative analog portion of the start signal exceeds the threshold criteria for a duration equal to time of occurrence of the end of the last pulse or symbol of the start signal, the transition output from the delay device starts the clock in source 24. Threshold devices and integrators of appropriate design can determine whether the positive and negative analog portions of the start signal at the output of medium 13 meet the required threshold and duration criteria to provide the start signal for source 24. Once the clock in source 24 starts the proper timing signals are applied to sampler 16, converters 18 and 21. In addition, the proper timing signal is applied to code generator 20 (identical to the timing signal applied to code generator 6) to start its operation from the reset or start condition thereby placing code generator 20 in frame synchronization with code generator 6 of the transmitter. This provides the necessary frame synchronization mentioned hereinabove between the transmitter and receiver. The pilot tone detector of sync detector 26 could be a sharply tuned filter centered at the 4 KC pilot tone, which in cooperation with the clock maintains correct phasing or time coincidence between the transitions of the various timing signals in the transmitter and receiver and the transitions of the identical codes produced by generators 6 and 20 through the use of an automatic phase locked loop system. The pilot tone detector of detector 26 also turns off the start pulse detector of detector 26 when the output of received tone level exceeds a suitable threshold so that the start signal detector will not respond to communication and other signals, such as noise, at the output of medium 13 that may accidentally meet the threshold and duration criteria of the start signal. In addition, the pilot tone detector turns on the start signal detector and restores the initial conditions of the receiver when the level is not exceeded for an appropriate period of time which is an indication that communication has been completed.

Filter 15 must be so arranged that it will block the pilot tone which is simultaneously sent with the communication signal to maintain the bit phasing so that it cannot be heard in utilization device 23. This can be done by providing filter 15 with a cut off characteristic just below the pilot tone frequency.

Code generators 6 and 20 are identical as indicated above, so that they provide the desired identical "unpredictable" stream of binary bits at both the transmitter and the receiver.

Generators 6 and 20 may be realized by one of many different known configuration. One such configuration may include a clock pulse source coupled in tandem with a shaft register of many stages having appropriate feedback between selcted stages to produce the desired random "unpreditable" stream of binary bits.

Another configuration of generators 6 and 20 may include a peprogrammed recording having the desired stream of binary bits recorded thereon and a reader to read this bit stream off the recording for coupling to the input of adders 7 and 19.

Figure 3:
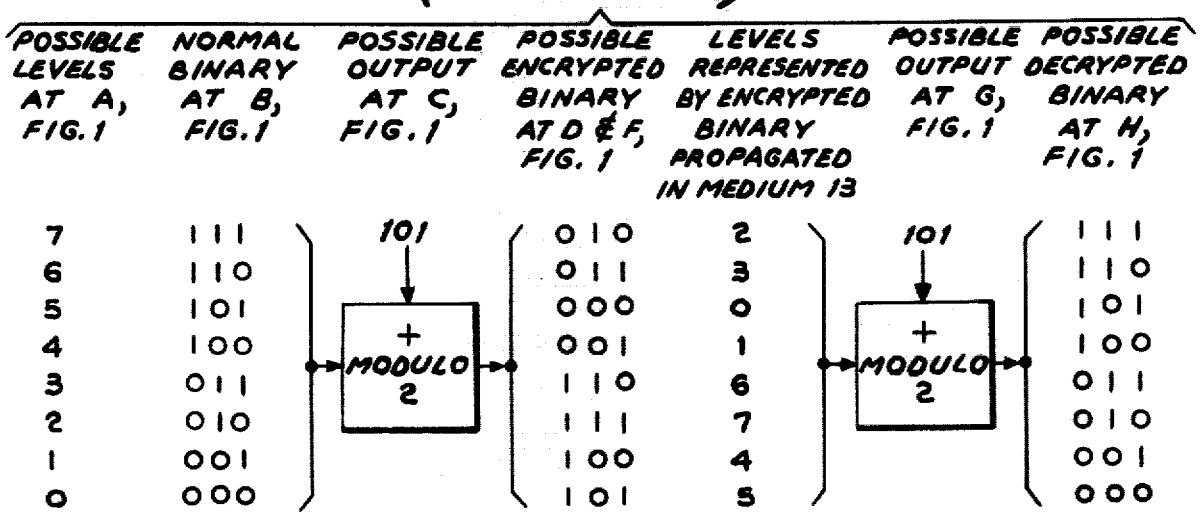
Fig. 3 (PRIOR ART)

Let us now consider the effect of transmission medium noise in the system of FIG. 1. This noise might be thermal in origin, it might be crosstalk from adjacent channels or other man-made noise, or it might be intersymbol interference, due to improper adjustment of the system or to dispersiveness or overloading of the transmission medium. In any case, if the transmission medium is to be useful, noise must not cause a large change in transmitted levels. FIG. 3 illustrates the relationship in FIG. 1 between possible levels at point A the normal binary representation of these levels appearing at point B, a possible output from generator 6 at point C, the encrypted binary at points D and F, the levels represented by the encrypted binary signal propagated in medium 13, the same possible output from generator 20 at point G and the possible decrypted binary at point H. If this figure is read horizontally, the relationships between the signals at various points of FIG. 1 is illustrated. Let us assume for instance that signal 1 has a level 3 at the output of quantizer 4 which will provide a 011 output from converter 5. When this is added modulo 2 to 101 the encrypted binary is 110 corresponding to a level 6 propagated through medium 13. Now let it be assumed that noise causes the level in the transmission medium 3 to change by one level, for instance, to level 5. Thus, level 5 will appear at the output of quantizer 17 and be converted to 101 in converter 18 which when added modulo 2 to 101 in adder 19 produces decrypted binary at the output of adder 19 of 000. If noise had not interfered with the level propagated through medium 13, level 6 should have been at the output of quantizer 17 producing at the output of converter 19 011. Thus, it is seen that a one level change in medium 13 due to noise causes a four level change in the output of adder 19 and, hence, at the output of converter 21. Thus, a one level change at the receiver input due to noise in medium 13 causes a many level change at the output. In these cases, encryption according to the arrangement of FIG. 1 effectively amplifies the noise in the medium 13. This noise amplification becomes more drastic when the number of levels is greater than the eight levels illustrated for purposes of explanation.

The arrangements now to be described in accordance with the principles of this invention prevent the above described noise amplification occurring in prior art systems, such as the system of FIG. 1. The improved cryptographically secure system of this invention provides only an m-level output change with an m-level change in the transmission medium due to noise. This improvement will be described and explained in greater detail hereinbelow.

Figure 4:
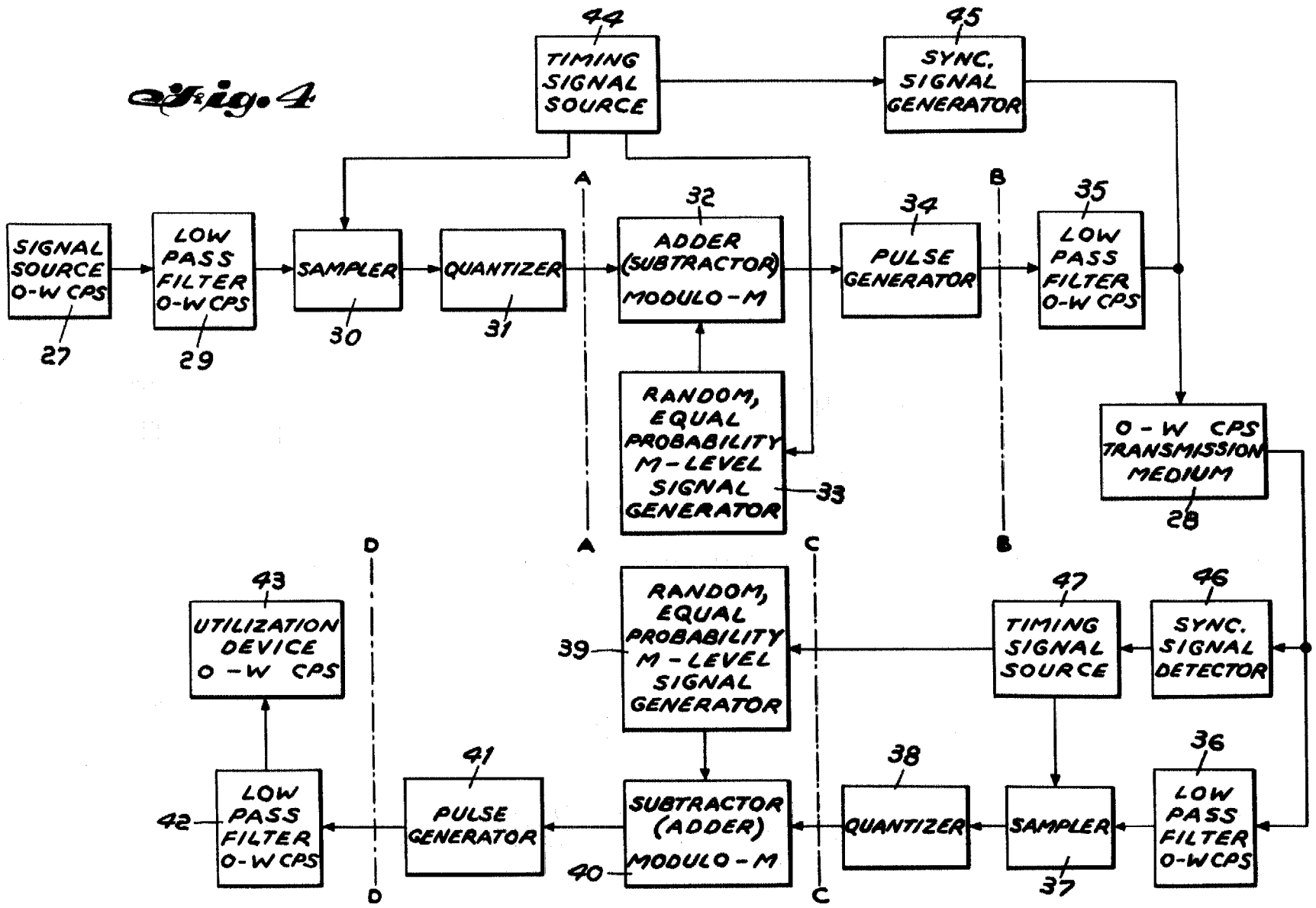
FIG. 4 is a block diagram of the cryptographically secure communication system in accordance with the principles of this invention.

Referring to FIG. 4, there is illustrated therein a cryptographically secure communication system in accordance with the principles of this invention overcoming the disadvantage of the prior art pointed out hereinabove. As in the prior art the signal from source 27 is confined to a low frequency pass band having a bandwidth of o-w cps which is equal to the pass band and bandwidth of transmission medium 28, such as a telephone channel. The output from source 27 is coupled to filter 29 of the low pass type and, hence, to sampler 30. The signal of source 27 is sampled in accordance with the sampling theorem mentioned hereinabove. The output of sampler 30 is quantized to discrete amplitude levels in quantizer 31. Let it be assumed that the output of sampler 30 is quantized to one of M levels in quantizer 31. The output from quantizer 31 is coupled to an adder 32 which receives its other input from signal generator 33 which is capable of providing randomly and with equal probability M level signals. The output from quantizer 31 and the output from signal generator 33 are coupled to adder 32 and are added to each other modulo M. The output from adder 32 is then coupled to pulse generator 34 to provide a pulse output for application to low pass filter 35 for effective integration of the output of generator 34. The output from filter 35 is then coupled to medium 28 and, hence, to low pass filter 36 in the form of an encrypted analog signal. Sampler 37 samples the encrypted analog signal with these samples being quantized by quantizer 38.

Signal generator 39 is provided at the receiver which produces M level signals randomly and with equal probability, identical to the output of signal generator 33 in the transmitter. Generators 33 and 39 are synchronous.

The output from generator 39 is subtracted modulo M from the output from quantizer 38 by subtractor 40. The resultant of this subtraction is coupled to pulse generator 41 and, hence, to low pass filter 42 for utilization in utilization device 43. The output from pulse generator 41 will be the decrypted version of the pulse signal from quantizer 38 and will be substantially identical with the output of quantizer 31 thereby enabling the recovery of the signal of source 27.

As in the case of the prior art, as described hereinabove with respect to FIG. 1, both frame and bit synchronization is required between the transmitter and the receiver. As described hereinabove with respect to FIG. 1 this synchronization is provided through the cooperation of timing signal source 44 and sync signal generator 45 in the transmitter and sync signal detector 46 and timing signal source 47 in the receiver. These circuits would employ the components and techniques as outlined hereinabove for timing signal source 12 and sync signal generator 25 at the transmitter and sync signal detector 26 and timing signal source 24 in the receiver to assure both frame and bit sync between generators 33 and 39. Low pass filter 36 is similar to low pass filter 15 of FIG. 1 and should be designed to prevent the passage of the pilot tone through the decrypting portion of the receiver to utilization device 43.

Generators 33 and 39 provide identical M level signal outputs. Each of the generators may take the form of a many stage shift register coupled to a clock source with appropriate feedback between selected stages of the shift register to produce binary representation of M levels in sequence and which over a long period of time produces a binary representation of each of the M levels randomly and with equal probability. The output from the shift register is then applied to a digital to PAM converter to produce pulses coincident with the pulses at the output of each of the quantizers 31 and 38.

Each of generators 33 and 39 may also be realized by a preprogrammed recording and associated readout means with the recording containing the M level signals in a random relationship and equal probability.

Another configuration of generators 33 and 39 may be realized by employing coding mask techniques. That is, a member is configured to have a particular type of code pattern disposed thereon. For instance, light transparent areas may be provided to produce the "1"s of the code group representing the different M levels. In place of the light transparent areas there may be substituted capacitive material areas or magnetic material areas. Associated with the coding mask is an appropriate scanning arrangement, a light scanning arrangement, such as a cathode ray tube, for the mask with light transparent areas, a capacitive scanning arrangement where the mask includes capacitive material areas, and a magnetic scanning arrangement where the mask includes magnetic material areas. The scanning arrangement employed will have its vertical scan controlled by a programmed vertical deflection system randomly to scan each of the M levels with equal probability while the horizontal scan will be arranged to provide the binary representation of each of the M levels reached by the vertical scan. The resultant binary representation produced is then operated on by a digital to PAM converter to produce the desired discrete amplitude pulses. It should be noted that the areas mentioned hereinabove for the various coding masks may be arranged in a pattern where the areas represent "0"s of the binary representation of each of the M levels.

Figure 5:
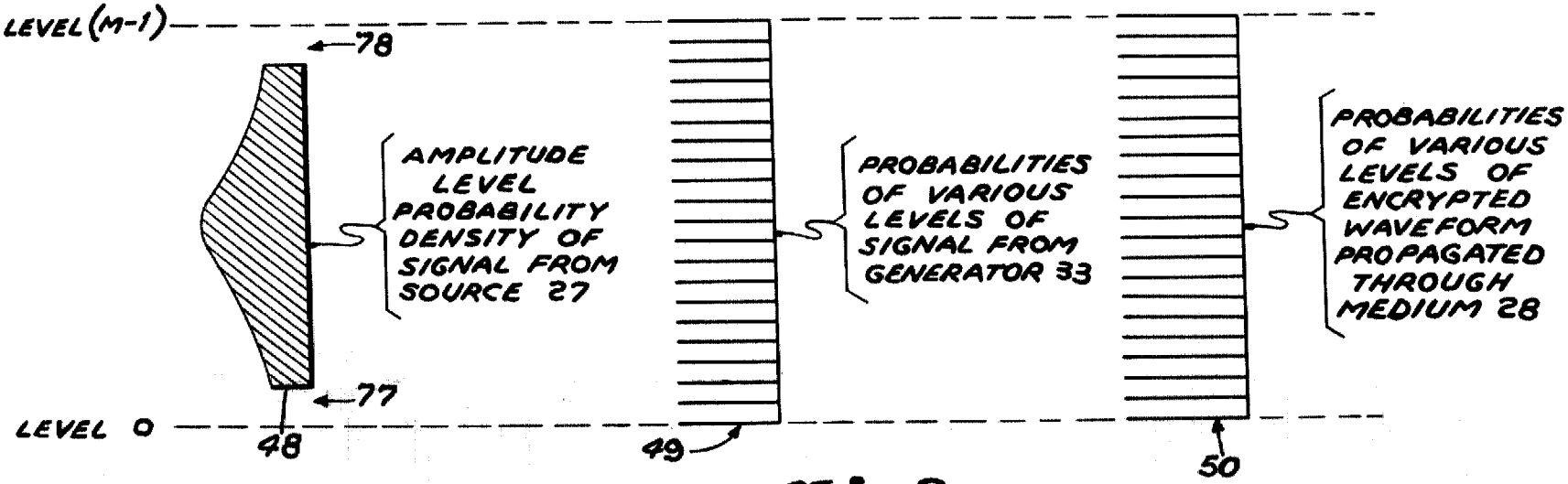
FIG. 5 is a symbolic representation of the cryptographically secure nature of the system of FIG. 4.

Referring to FIG. 5, there is illustrated therein the amplitude level probabilities and probability density of the signals at various portions of the system of FIG. 4. The amplitude level probability density of the signal from source 27 is illustrated at 48 wherein the highest probability of signal density from source 27 is confined to the mid range of M amplitude levels. The probabilities of various amplitude levels from the signal from generator 33 is illustrated at 49 wherein this signal is random and equally probably throughout the M levels of the system. When this probability of amplitude level of the signal from generator 33 is utilized to encrypt the signal from source 27, the probabilities of various amplitude levels of the encrypted waveform propagated through medium 38 is illustrated at 50. Thus, if the amplitude level output from generator 33 occupies all levels randomly and with equal probability and no memory of its previous levels, the modulo M sum of the singal from generator 33 and any input waveform from source 27 emerges with all levels equally occupied and without memory. Therefore, the system of FIG. 4 is cryptographically secure.

Finally, if the input is prevented from occupying a few of the levels at either extreme, such as illustrated at 77 and 78 of FIG. 5, a large error must occur in the transmission medium before the receiver will mistake a level near one extreme for a level near the other extreme.

The system of FIG. 4 has been described with an adder 32 in the transmitter and a subtractor 40 in the receiver. The same results may be obtained if component 32 in the transmitter is a subtractor and if component 40 in the receiver is an adder.

Figures 6, 7:
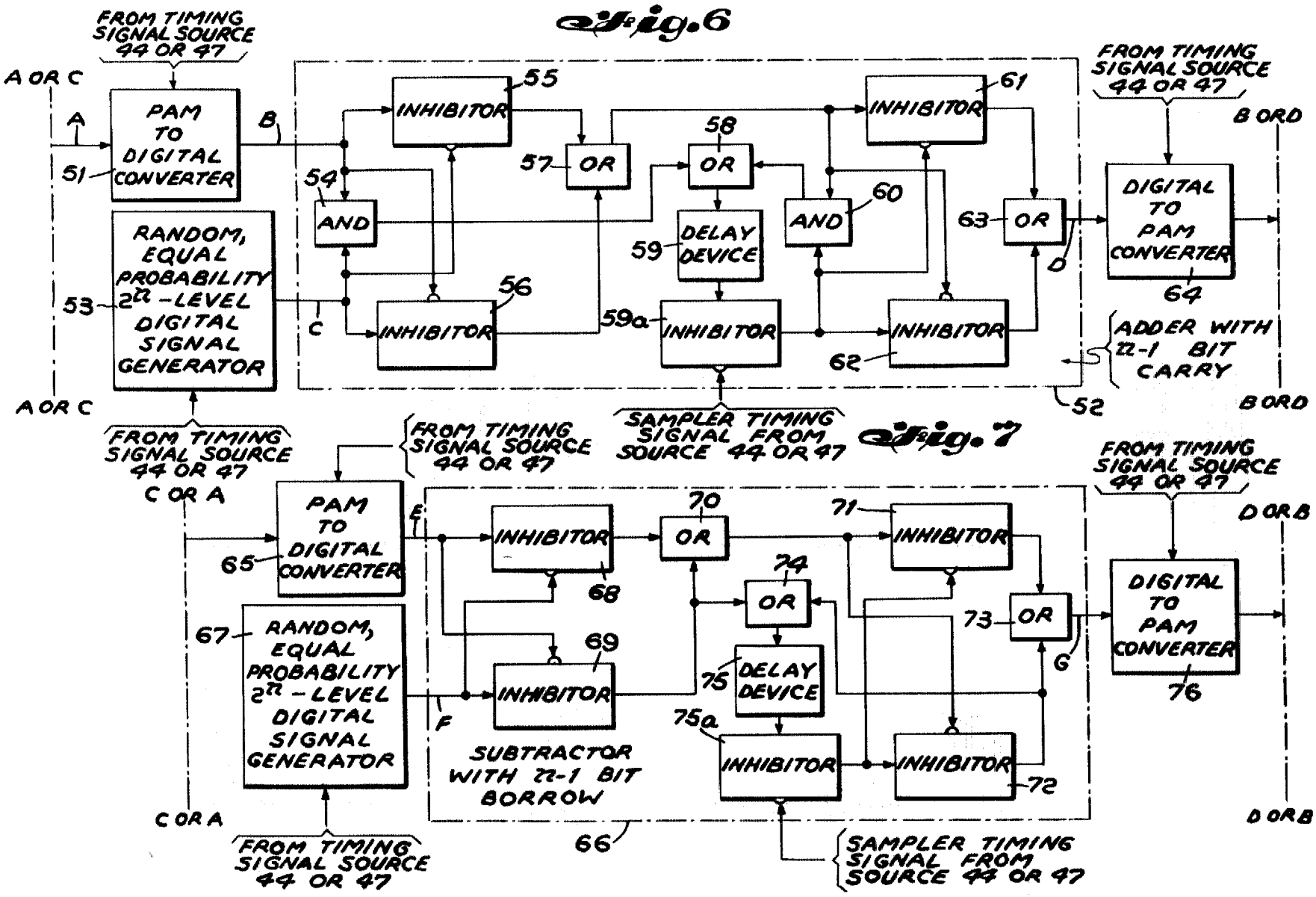
FIGS. 6 and 7 illustrate in block diagram form components to convert the system of FIG. 4 to two different binary systems in accordance with the principles of this invention one system being realized when

Referring to FIGS. 6 and 7, there is disclosed therein an arrangement which will allow the encrypting and decrypting operations of FIG. 4 to be binary in form rather than multilevel in form as described hereinabove. Let us assume that the components of FIG. 6 are substituted for the components of FIG. 4 between lines A—A and B—B and that the components of FIG. 7 are substituted for the components of FIG. 4 between lines C—C and D—D.

Referring to FIG. 6, the input to converter 51 is coupled to the output of quantizer 31 and converts the quantized sample pulses to a binary representation thereof with least significant bit first. The output is coupled to adder 52 with (n−1) bit carry where n equals the number of binary bits representing a quantized or discrete amplitude level. Signal generator 53 is substituted for signal generator 33 and provides digital or binary representations of $2^n$ levels randomly and with equal probability. The output from generator 53 is also coupled to adder 52. Adder 52 may take the form illustrated including AND gate 54, inhibitor 55, inhibitor 56 and OR gate 57. The inhibitors 55 and 56 and the OR gate 57 operate in the same manner as adder 7 or adder 19 of FIG. 1 to produce simple binary addition. The purpose of AND gate 54 is to provide the carry for binary addition. Thus, when a "1" bit appears at point B and a "1" bit appears at point C there will be an output from AND gate 54 to produce the desired carry which is coupled to OR gate 58. The output from OR gate 58 is coupled to delay device 59 which has a time delay equal to the time between adjacent bits of a group of binary bits representing a discrete amplitude level. The output from OR gate 57 is coupled to AND gate 60 and inhibitor 61 while the output from delay device 59 is coupled through inhibitor **59*a* to AND gate 60 and inhibitor 62. The outputs from inhibitors 61 and 62 are then coupled to OR gate 63. The inhibit terminal is coupled to the sampler timing signal of sources 44 or 47** to stop "carry" after n−1 bits to ready adder for operation on the next sample.

To more fully explain the operation of adder 52, let it be assumed that we are going to add 111 to 101. With a "1" at point B and a "1" at point C inhibitors 55 and 56 will be inhibited with no output coupled to OR gate 57. However, since two "1"s are coupled to AND gate 54 there will be a carry of "1" to OR gate 58. Since there is no input to OR gate 57 there will be no output therefrom and there will be no output from inhibitor 61 and no output from OR gate 63. Thus, the addition of two "1"s result in a "0." The next digits applied to the input of adder 52 are "1" at point B and "0" at point C which results in a "1" output from OR gate 57 and no carry (no output from AND gate 54). Remembering that there was carry in the previous adding operation there will be a "1" output applied to inhibitor 62. With a "1" output from delay device 59 and a "1" output from OR gate 57 inhibitors 61 and 62 will have no output resulting in a "0" output from OR gate 63. However, there will be a carry output from AND gate 60 which is coupled to OR gate 58 and, hence, to delay device 59. The next two digits applied to adder 52 are both "1." Here again inhibitors 55 and 56 are inhibited and no output appears at OR gate 57. However, due to the carry in the previous step of addition there is a "1" output from delay device 59 and, hence, a "1" output from inhibitor 62 and OR gate 63. The result of adding the above two three bit signals with two bit carry results in an output from adder 52 of 100. It should be pointed out that there is actually a carry output from AND gate 54 in the last adding step but this is disregarded due to inhibitor 59*a* since there is no further digit addition which this carry would effect.

The resultant output from the adder 52 is coupled to a digital to PAM converter 64 which produces the necessary and desired encrypted sample pulses.

To continue the description of FIG. 4 in its binary form let us turn to FIG. 7 which is substituted between lines C—C and D—D of FIG. 4. The output from quantizer 38 is coupled to PAM to digital converter 65 whose output is then a binary representation of the encrypted sample pulses for application to subtractor 66 with an (n − 1) bit borrow. The other input to subtractor 66 is provided from signal generator 67 which is identical in nature with signal generator 53, FIG. 6 and runs synchronously therewith. The binary representation of the $2^n$ levels are applied from the output of generator 67 to subtractor 66.

Subtractor 66 includes inhibitor 68, inhibitor 69, and OR gate 70 which functions substantially as described hereinabove with respect to adder 7. The output of OR gate 70 is coupled to the input terminal of inhibitor 71 and the inhibit terminal of inhibitor 72 with the outputs from inhibitors 71 and 72 being coupled to an OR gate 73. The borrow function of subtractor 66 is carried out by coupling OR gate 74 to the output of inhibitor 69 and also to the output of inhibitor 72. As in the case of the adder 52 there is provided a delay device 75 which has a time delay equal to the time space between adjacent digit pulses to be subtracted and an inhibitor 75*a* to stop "borrow" process after m − 1 bits, inhibitor 75*a* being inhibited or blocked by the sampler timing pulse from source 44 or 47.

To more fully explain the operation of subtractor 66, let it be assumed that we are going to subtract 101 from 100. With a "0" at point E and a "1" at point F, inhibitor 69 will pass a "1" to OR gate 70 and OR gate 74. The "1" output of OR gate 70 is passed through inhibitor 71 to OR gate 73 and, hence, to the output of subtractor 66. The next inputs to subtractor 66 are both "0"s. This results in a "0" output from inhibitors 68 and 69 and, therefore, a "0" output from OR gate 70. At this time the "1" borrow due to the preceding subtraction step is at the output of delay device 75. Thus, inhibitors 72 and 75*a* will pass a "1" to OR gate 73 and, hence, to the output of subtractor 66. The "1" output of inhibitor 72 is also coupled to OR gate 74 and then to delay device 75 to become a borrow. The next two bit inputs to subtractor 66 are both "1." Inhibitors 68 and 69 will then be both inhibited resulting in a "0" output from OR gate 70. The "1" borrow from the preceding subtraction step will pass through inhibitor 72 and provide a "1" output from OR gate 73. Although a borrow is present due to the last operation it is disregarded due to action of inhibitor 75*a*. The result of the above subtraction of the two three bit signals with two bit borrow results in an output from subtractor 66 of 111.

The output from OR gate 73, the output of subtractor 66, is coupled to digital to PAM converter 76 with the resultant decrypted sample pulses being coupled to low pass filter 42.

Figure 8:
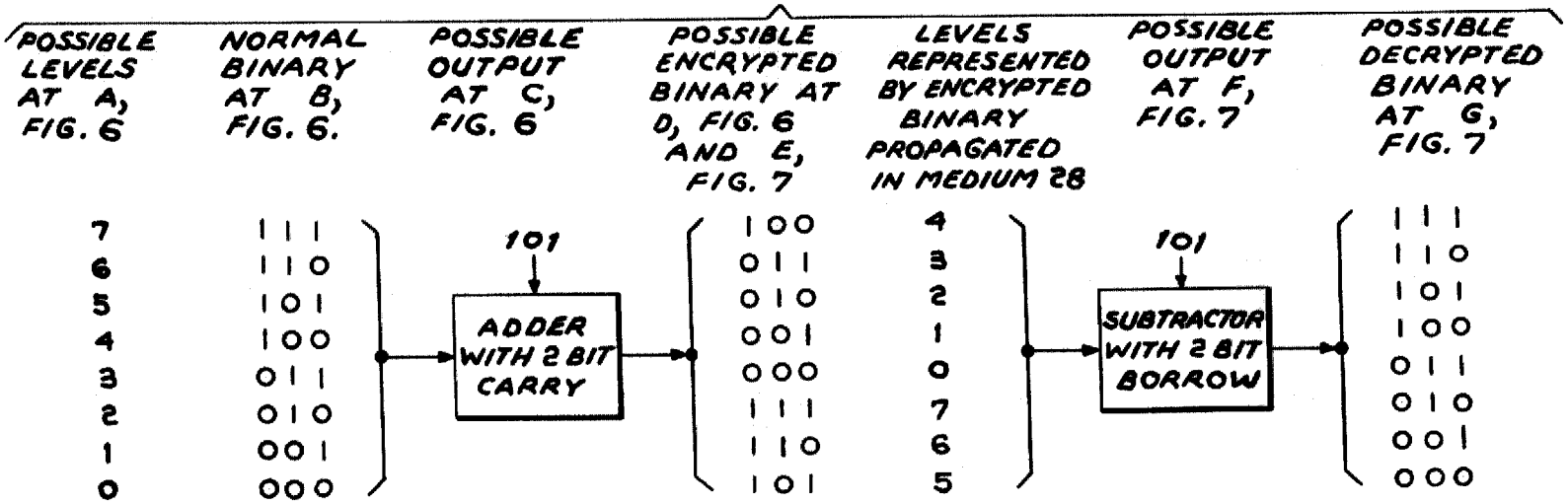
FIG. 8 is a symbolic illustration useful in illustrating the advantage of the system of FIG. 4 when

FIG. 8 is similar to the illustration of FIG. 3 and illustrates therein the operation of the binary form of FIG. 4 just described with respect to FIGS. 6 and 7. Let it be assumed that the level at the output of quantizer 31 is 5 which will result in a digital representation of 101 at the output of converter 51. When this digital representation is added with two bit carry to the 101 output of generator 53 there is obtained the encrypted binary representation 010 which represents level 2 at the output of converter 64. This level is applied to transmission medium 28 for propagation therethrough. When this level 2 is converted to a binary representation 010 in converter 65 and subtracted from the 101 output of generator 67 with a two bit borrow there is reobtained the binary representation 101 which represents level 5, the same level supplied by quantizer 31. This illustrates the encryption process and how the original signal level is obtained for utilization.

Let it be assumed now that level 2 in medium 28 is disturbed by noise therein in a manner to be reduced to level 1. When this disturbed level is coded in converter 65 there is obtained the binary representation 001 which when decrypted in subtractor 66 results in a binary output 100 which becomes level 4 when operated upon by converter 76. Thus, a one level change due to noise in medium 28 produces only a one level change in the output of converter 76 thereby eliminating the amplification of the noise disturbances in the medium 28. Thus, for an m-level change due to noise in medium 28 there is only an m-level change in the output level. Thus, it may be stated that a small error in level caused by the transmission medium is translated into an equal output error.

The system of FIG. 4 has been described in its binary form with the components of FIG. 6 being incorporated in the transmitter of FIG. 4 between lines A—A and B—B and with the components of FIG. 7 disposed in the receiver of FIG. 4 between lines C—C and D—D. It should be pointed out and particularly noted herein that components of FIG. 7 can be placed between lines A—A and B—B in the transmitter of FIG. 4 while the components of FIG. 6 can be disposed between lines C—C and D—D of the receiver of FIG. 4.

Generators 53 and 67 provide identical binary signal outputs that represent $2^n$ levels. Each of these generators may be realized either in the form of the shift register arrangement or coding mask arrangement as described hereinabove for generators 33 and 39 without the digital to PAM converter. Also generators 53 and 67 may be realized by a preprogrammed recording and associated read out means with the recording containing the binary representations of the $2^n$ level signals in the required relationship.

While we have described above the principles of our invention in connection with specific apparatus it is to be clearly understood that this description is made only by way of example and not as a limitation to the scope of out invention as set forth in the objects thereof and in the accompanying claims.

We Claim:

1. A cryptographically secure communication system employed with a transmission medium having a given low frequency pass band and a predetermined bandwidth comprising:

a source of analog signal confined to said given pass band and said predetermined bandwidth;

first means coupled to said source to produce amplitude sample pulses from said analog signal at a given rate related to at least twice said predetermined bandwidth, each of said sample pulses having a discrete amplitude equal to one of a predetermined number of discrete amplitude levels;

second means to provide a first sequence of signals representing randomly and with substantially equal probability said predetermined number of discrete amplitude levels, said first sequence of signals being coincident with said sample pulses;

third means coupled to said first means and said second means responsive to said sample pulses and said first sequence of signals to encrypt said sample pulses;

said transmission medium;

fourth means coupled between said third means and said transmission medium to convert said encrypted sample pulses to an encrypted analog signal confined to said given pass band and said predetermined bandwidth for propagation through said transmission medium;

fifth means coupled to said transmission medium to produce encrypted amplitude sample pulses from said encrypted analog signal at said given rate, each of said encrypted sample pulses having a discrete amplitude equal to one of said predetermined number of discrete amplitude levels;

sixth means synchronous with said second means to provide a second sequence of signals identical to said first sequence of signals, said second sequence of signals being coincident with said encrypted sample pulses;

seventh means coupled to said fifth means and said sixth means responsive to said encrypted sample pulses and said second sequence of signals to decrypt said encrypted sample pulses and recover said sample pulses;

eighth means coupled to said seventh means to convert said sample pulses to said analog signal confined to said given pass band and said predetermined bandwidth; and ninth means coupled to said eighth means having said given pass band and said predetermined bandwidth to utilize said analog signal.

2. A system according to claim 1, wherein said predetermined number of discrete amplitude levels equal M, is an integer;

said third means includes means to add said first sequence of signals to said sample pulses modulo M; and said seventh means includes means to subtract said second sequence of signals from said encrypted sample pulses modulo M.

3. A system according to claim 2, wherein said first means includes tenth means coupled to said source to sample said analog signal at said given rate, and eleventh means coupled between said tenth means and said means to add to quantize said sample pulses; and said fifth means includes twelfth means coupled to said transmission medium to sample said encrypted analog signal at said given rate, and means coupled between said twelfth means and said means to subtract to quantize said encrypted sample pulses.

4. A system according to claim 1, wherein said predetermined number of discrete amplitude levels equal M, where M is an integer;

said third means includes means to subtract said first sequence of signals from said sample pulses modulo M; and said seventh means includes means to add said second sequence of signals to said encrypted sample pulses modulo M.

5. A system according to claim 4, wherein said first means includes tenth means coupled to said source to sample said analog signal at said given rate, and eleventh means coupled between said tenth means and said means to subtract to quantize said sample pulses; and said fifth means includes twelfth means coupled to said transmission medium to sample said encrypted analog signal at said given rate, and means coupled between said twelfth means and said means to add to quantize said encrypted sample pulses.

6. A system according to claim 1, wherein said predetermined number of discrete amplitude levels equal $2^n$, where n is an integer equal to the number of binary bits representing each of said discrete amplitude levels;

said second means provides said first sequence of signals in binary form;

said third means includes tenth means coupled to said first means to convert the amplitude of said sample pulses into a binary representation thereof, and binary adder means with an $(n-1)$ bit carry coupled to said second means and said tenth means to add the binary output of said second means to the binary output of said tenth means;

said sixth means provides said second sequence of signals in binary form; and said seventh means includes eleventh means coupled to said fifth means to convert the amplitude of said encrypted sample pulses into a binary representation thereof, and binary subtractor means with an $(n-1)$ bit borrow coupled to said sixth means and said eleventh means to subtract the binary output of said sixth means from the binary output of said eleventh means.

7. A system according to claim 6, wherein said fourth means includes twelfth means coupled to said adder means to convert the binary output of said adder means to said encrypted sample pulses, and low pass filter means having said given pass band and said predetermined bandwidth coupled to said twelfth means to convert said encrypted sample pulses to said encrypted analog signal; and said eighth means includes thirteenth means coupled to said subtractor means to convert the binary output of said subtractor means to said sample pulses, and low pass filter means having said given pass band and said predetermined bandwidth coupled to said thirteenth means to convert said sample pulses to said analog signal.

8. A system according to claim 1, wherein said predetermined number of discrete amplitude levels equal $2^n$, where n is an integer equal to the number of binary bits representing each of said discrete amplitude levels;

said second means provides said first sequence of signals in binary form;

said third means includes tenth means coupled to said first means to convert the amplitude of said sample pulses into a binary representation thereof, and binary subtractor means with a $(n-1)$ bit borrow coupled to said second means and said tenth means to subtract the binary output of said second means from the binary output of said tenth means;

said sixth means provides said second sequence of signals in binary form; and said seventh means includes eleventh means coupled to said fifth means to convert the amplitude of said encrypted sample pulses into a binary representation thereof, and a binary adder means with a $(n-1)$ bit carry coupled to said sixth means and said eleventh means to add the binary output of said sixth means to the binary output of said seventh means.

9. A system according to claim 8, wherein said fourth means includes twelfth means coupled to said subtractor means to convert the binary output of said subtractor means to said encrypted sample pulses, and low pass filter means having said given pass band and said predetermined bandwidth coupled to said twelfth means to convert said encrypted sample pulses to said encrypted analog signal; and said eighth means includes thirteenth means coupled to said adder means to convert the binary output of said adder means to said sample pulses, and low pass filter means having said given pass band and said predetermined bandwidth coupled to said thirteenth means to convert said sample pulses to said analog signal.

10. A system according to claim 1, wherein said first means includes tenth means coupled to said source to sample said analog signal at said given rate, and eleventh means coupled between said tenth means and said third means to quantize said sample pulses; and said fifth means includes twelfth means coupled to said transmission medium to sample said encrypted analog signal at said given rate, and means coupled between said twelfth means and said seventh means to quantize said encrypted sample pulses.

* * * * *